United States Patent [19]

Achelpohl

[11] 4,022,151

[45] May 10, 1977

[54] APPARATUS FOR PIVOTING A TENSIONED WEB OF MATERIAL AWAY FROM AN ADHESIVE APPLICATOR ROLLER THEREFOR

[75] Inventor: Fritz Achelpohl, Lengerich, Germany

[73] Assignee: Windmoller & Holscher, Lengerich, Germany

[22] Filed: May 27, 1975

[21] Appl. No.: 580,960

[30] Foreign Application Priority Data

May 27, 1974 Germany ..... 2425534

[52] U.S. Cl. ..... 118/33; 118/246

[51] Int. Cl.[2] ..... B05C 1/08

[58] Field of Search ..... 118/246, 33, 247, 253; 242/75.3; 226/114

[56] References Cited

UNITED STATES PATENTS

| | | | |
|---|---|---|---|
| 2,873,719 | 2/1959 | Schubert | 118/247 |
| 3,061,226 | 10/1962 | Kegg | 242/75.3 |
| 3,684,144 | 8/1972 | Boudouris et al. | 226/114 |

*Primary Examiner*—John P. McIntosh
*Attorney, Agent, or Firm*—Fleit & Jacobson

[57] ABSTRACT

Apparatus for pivoting a tensioned web of material away from an adhesive applicator roller therefor comprises a guide roller for the web carried by first pivotal levers and a web tensioning bar extending parallel to the guide roller and carried by second pivotal levers so as to keep the web under tension when the first pivotal levers are swung to move the web past over the guide roller away from the applicator roller. Means are provided which are operative on pivoting of the first levers and which utilize the pivoting motion thereof for controlling pivoting movement of said second levers required to maintain or increase the tension in the web.

3 Claims, 2 Drawing Figures

APPARATUS FOR PIVOTING A TENSIONED WEB OF MATERIAL AWAY FROM AN ADHESIVE APPLICATOR ROLLER THEREFOR

The invention relates to an apparatus for pivoting a tensioned web of material away from an adhesive applicator roller therefor and comprising a guide roller mounted on pivotal levers and a web tensioning bar extending parallel to the guide roller.

In a machine for treating or processing a web of paper or plastics film and comprising an adhesive applicator mechanism including an applicator roller, certain types of adhesive make it necessary to allow the applicator roller to continue to rotate if the machine has to be stopped. This is done so that the adhesive in a supply chamber adjacent the applicator roller continues to be agitated or circulated and so that the part of the applicator roller projecting from the supply chamber is not unduly cooled, which would result in the adhesive setting on the applicator roller.

During short periods of standstill of the machine and the continued rotation of the applicator roller, the web of material that is to be coated has to be separated or swung away from the applicator mechanism because otherwise adhesive would be continually applied to the web at one and the same position, thereby creating difficulties during the further processing of the material.

In an apparatus that has found practical application for swinging the web away from the applicator roller, the guide roller is disposed above the applicator roller. The web travels downwardly past the applicator roller. The guide roller holds the web at a predetermined angle to the applicator roller and is mounted on pivotal levers by means of which it can be swung about an axis parallel to its rotary axis. To prevent the web of material from becoming slack when the guide roller is swung away, which could cause the web to touch the applicator roller unintentionally, the pivotal levers supporting the guide roller also support a web tensioning bar extending parallel to the guide roller. If this known apparatus were to be used for a web travelling upwardly past the applicator roller, there would be a danger that the web tensioning bar that is now disposed below the applicator roller becomes soiled by drops of adhesive. When the machine is now started again, the web tensioning bar could become stuck to the web. Further, the known apparatus is capable of swinging the web tensioning bar an adequate distance only if the bar is mounted on the applicator roller-supporting levers at a sufficient distance from the applicator roller. This, in turn, would make it necessary for the web tensioning bar to be located very close to the applicator roller, thereby affecting the accessibility of the applicator mechanism.

It is an object of the invention to provide an apparatus of the aforementioned kind in which the web tensioning bar can be moved an adequate distance for avoiding slack in the material when the guide roller is swung away, and this independently of the spacing between the web tensioning bar from the applicator roller or guide roller.

According to the invention, an apparatus for pivoting a tensioned web of material away from an adhesive applicator roller therefor comprises a guide roller for the web carried by first pivotal levers, a web tensioning bar extending parallel to said guide roller and carried by second pivotal levers, and means utilising pivoting motion of said first levers for controlling pivoting movement of said second levers required to maintain or increase the tension in said web.

The invention therefore permits the position and displacement of the web tensioning bar to be adapted to particular requirements.

Desirably, the first pitoval levers are operatively coupled to the second pivotal levers so as to transmit thereto a pivoting movement that overtakes the motion of said guide roller. The movement of the web tensioning bar could also be so designed that the tension in the web is increased when the guide roller is swung away, thereby positively avoiding contact between the web and applicator roller caused by possible oscillations of the web.

To control the movement of the second pivotal levers carrying the web tensioning bar, an operative connection to the first pivotal levers can be very simply brought about in that the pivotal axes of the first levers are spaced from those of the second levers and the second levers are provided with cam means displaceable in slots in said first levers. Naturally, an alternative arrangement would be for the first levers to be provided with the cam means and the second levers with the slots.

The pivotal angles can be determined by the lengths of the levers up to the coupling point and the pivotal paths can be determined by the entire lever lengths.

An example of the invention will now be described with reference to the accompanying diagrammatic drawing, wherein.

Figure 1:
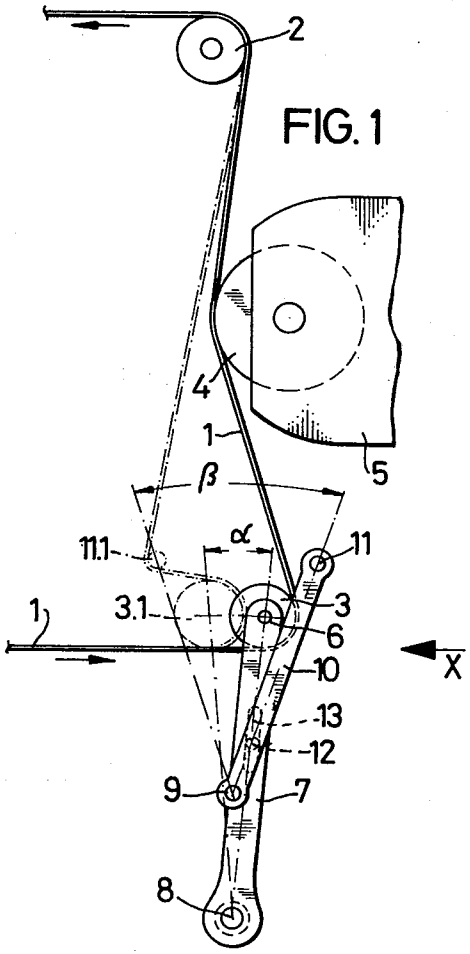
FIG. 1 is a side elevation of a pivoting and tensioning apparatus.
Figure 2:
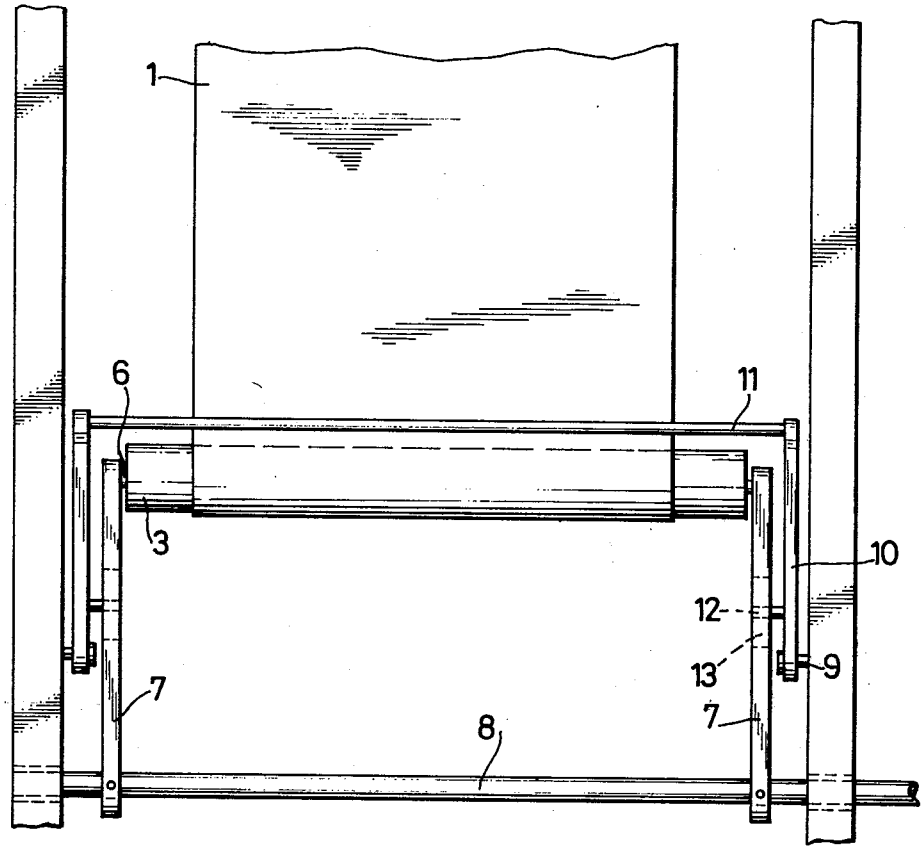
FIG. 2 is an elevation in the direction of the arrow X in FIG. 1.

A web 1 of material to be coated with adhesive travels between guide rollers 2 and 3 over an applicator roller 4 of an applicator mechanism. Only the cover plate or housing 5 of the applicator mechanism is visible in FIG. 1.

The guide roller 2 is rotatably mounted in the frame of the apparatus. The guide roller 3 is rotatable on a shaft 6 fixed at each end to a lever 7. The levers 7 are fixed to a shaft 8 rotatable in the frame of the apparatus, means being provided (not shown) for rotating the shaft 8 through an angle $\alpha$. Pins 9 are screwed into the frame of the apparatus for pivotally supporting respective levers 10. The levers 10 are interconnected by a web tensioning bar 11 which extends parallel to the guide roller 3 and is disposed beneath the housing 5 when it is in an inoperative position. Fixed to the levers 10 there are pins or cam means 12 which are displaceable in a slideway 13 of each lever 7. The spacing between the pins 9 and pins 12 is substantially smaller than the spacing between the pins 12 and the web tensioning bar 11. Movement of the levers 7 through an angle $\alpha$ causes the levers 10 to move through a considerably larger angle $\beta$. Only a short path therefore needs to be travelled by the guide roller 3 to reach the position indicated at 3.1 in order to move the web tensioning bar 11 from its inoperative position to the one indicated at 11.1 in chain-dotted lines. The web 1 would become slack if the guide roller 3 were to be brought to the position 3.1 without the provision of a web tensioning bar. By simultaneous swinging motion of the bar 11 to the operative position 11.1, however, the web 1 remains under tension even during the pivotal motion.

Since the web tensioning bar 11 follows the motion, a small piivotal movement of the guide roller 3 suffices to swing the web 1 away from the applicator roller 4. The latter can continue to rotate during standstill of a web processing machine without the web 1 touching same and continually having adhesive applied thereto.

The use of the lever mechanism consisting of the levers 7 and 10 and the pins 9 and 12 enables the web tensioning bar 11 to be positioned at an adequately large spacing from the applicator mechanism so that the latter can be readily serviced whereas in the inoperative position of the web tensioning bar, when the applicator roller is operative, the bar is disposed in a protected position beneath the applicator mechanism where it cannot be soiled by adhesive dripping from the roller 4.

The length of web that is released when the guide roller 3 is swung through the angle $\alpha$ is compensated by the fact that the angle $\beta$ is larger than the angle $\alpha$ in the ratio of the spacings of the coupling points 12 from the pivotal axes of the pins 9 and the shaft 8, the length of the arc traversed by the web tensioning bar 11 being proportional to the length of the lever 10.

I claim:

1. Apparatus for pivoting a tensioned web of material away from an adhesive applicator roller therefor comprising in combination, first pivotal levers, a guide roller for the web mounted on said first pivotal levers, said guide roller being movable by said first pivotal levers between a first position for holding the web against the adhesive applicator roller and a second position for permitting the web to move away from the adhesive applicator roller, second pivotal levers, a web tensioning bar extending parallel to said guide roller mounted on said second pivotal levers, means for pivotally moving said second levers in response to the pivotal movement of said first levers to position said web tensioning bar in an inoperative position out of engagement with the web in the first position of said guide roller and in an operative position in tensioning engagemment with the web in the second position of said guide roller with the web away from the adhesive applicator roller.

2. Apparatus according to claim 1 wherein said means for pivotally moving said second pivotal levers comprise means for operatively coupling said first pivotal levers to said second pivotal levers, said coupling means being arranged to move said web tensioning bar in the same direction as said guide roller during the movement of said guide roller from said first position to said second position with said web tensioning bar moving from said inoperative position behind said guide roller to said operative position in front of said guide roller.

3. Apparatus according to claim 2 wherein the pivot axis of said first levers is spaced from the pivot axis of said second levers and wherein said coupling means comprise slots in said first levers and cam means on said second levers displaceable within said slots in said first levers.

* * * * *